United States Patent [19]

Alperson

[11] Patent Number: 4,940,148

[45] Date of Patent: Jul. 10, 1990

[54] RETAIL DISPLAY WIRE CUBE

[76] Inventor: Joel H. Alperson, 3306 S. 157th St., Omaha, Nebr. 68130

[21] Appl. No.: 335,888

[22] Filed: Apr. 10, 1989

[51] Int. Cl.[5] ..... A47F 5/14

[52] U.S. Cl. ..... 211/181; 211/126; 211/194; 206/513; 220/23.83; 312/107

[58] Field of Search ..... 211/194, 181, 188, 126, 211/133; 312/107; 220/23.6, 23.83; 206/513, 511

[56] References Cited

U.S. PATENT DOCUMENTS 3,314,549 4/1967 Goldreich et al. ..... 211/181 X
4,079,836 3/1978 VonStein et al. ..... 211/181 X
4,508,230 4/1985 Ashton ..... 211/194 X
4,705,178 11/1987 Vail, Sr. et al. ..... 211/194 X

*Primary Examiner*—Blair M. Johnson
*Attorney, Agent, or Firm*—George R. Nimmer

[57] ABSTRACT

Retail display wire cubes having upright sideward grids effected into spaced-apart parallel relationship with co-axially aligned rectangular spacing members that extend above and below the grids. The retail display wire cubes are adapted for secure removable attachment to a similar cube stacked immediately therebelow with U-shaped having vertical wings carried by terminal spacing members at locations below a grid and each clip including a toe-like lower-terminus projecting transversely outwardly from the vertical wings.

5 Claims, 1 Drawing Sheet

RETAIL DISPLAY WIRE CUBE

BACKGROUND OF THE INVENTION

Oftentimes, retailers display merchandise within wire cubes that are advantageously vertically stacked in securely removably attached relationship for effective showroom utilization. Traditionally such retail display cubes comprise upright sideward grids established in spaced-apart parallel relationship with coaxially aligned rectangular spacer members. The prior art teaches various devices for securely removably attaching vertically stacked wire cubes. In U.S. Pat. No. 4,705,178 (Vail—Nov. 10, 1987), the inter-cubes attachment means is predicated upon truncated spacer members that are purposefully recessed below the sideward grids. However, display cubes employing such truncated spacer members as cubes attachment means suffer from the disadvantages of reduced display volume and difficulty in effecting "plumbed" vertical relationship among stacked cubes. Other prior art inter-cubes attachment means are predicated upon expensive and complicated mechanical devices that require tedious manipulation to effect a "plumbed" vertical relationship among stacked cubes.

OBJECTIVE OF THE INVENTION

It is accordingly the general objective of the present invention to provide a retail display wire cube having improved inter-cubes attachment means that overcomes the disadvantages and deficiencies of prior art devices. It is an ancillary general objective to provide an inexpensive, quick, reliable, and secure removable attachment between vertically stacked wire cubes and including the provision of automatic vertical "plumb" among the stacked cubes.

GENERAL STATEMENT OF THE INVENTION

With the aforementioned general objectives in view, and together with specific and ancillary objectives which will become more apparent as this description proceeds, the retail display wire cubes of the present invention and particularly at the inter-cubes attachment means generally comprises U-shaped upright clips respectively carried at upright lower-lengths of terminal spacer members, each clip comprising spaced-apart vertical wings that are coplanar with and lie below a cube sideward grid, and each clip further comprising a lower-terminus located deeply below its host terminal spacer member and projecting transversely outwardly beyond the plane of its overlying grid.

BRIEF DESCRIPTION OF THE DRAWING

In the drawing, wherein like characters refer to like parts in the several views, and in which.

DETAILED DESCRIPTION OF THE DRAWING

Figure 1:
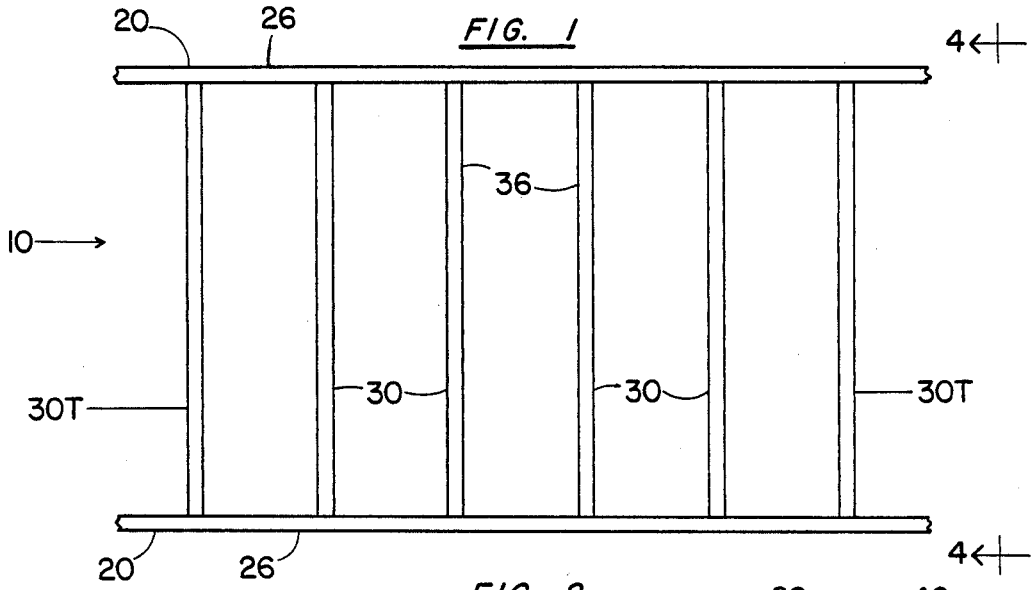
FIG. 1 is a top plan view of a representative embodiment (10) of the retail display cube of the present invention.
Figure 2:
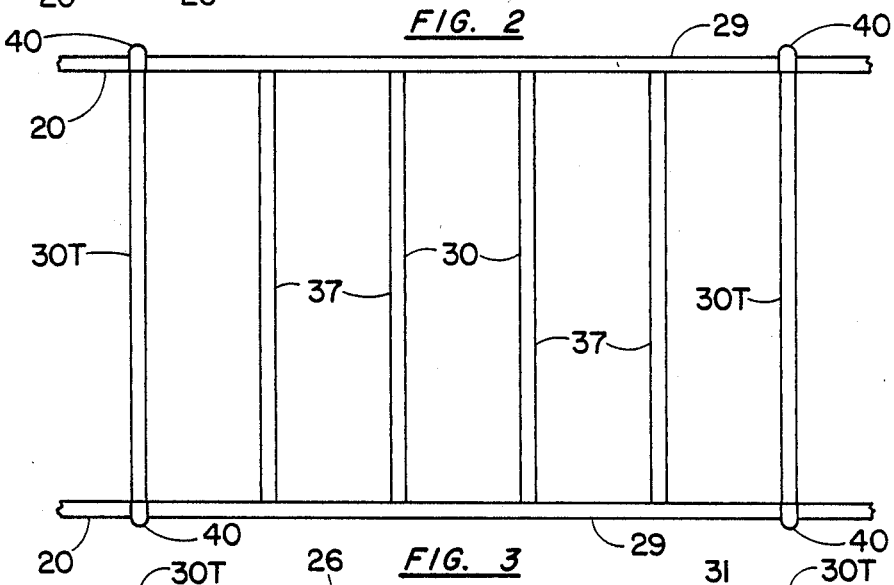
FIG. 2 is a bottom plan view of the FIG. 1 embodiment.
Figure 3:
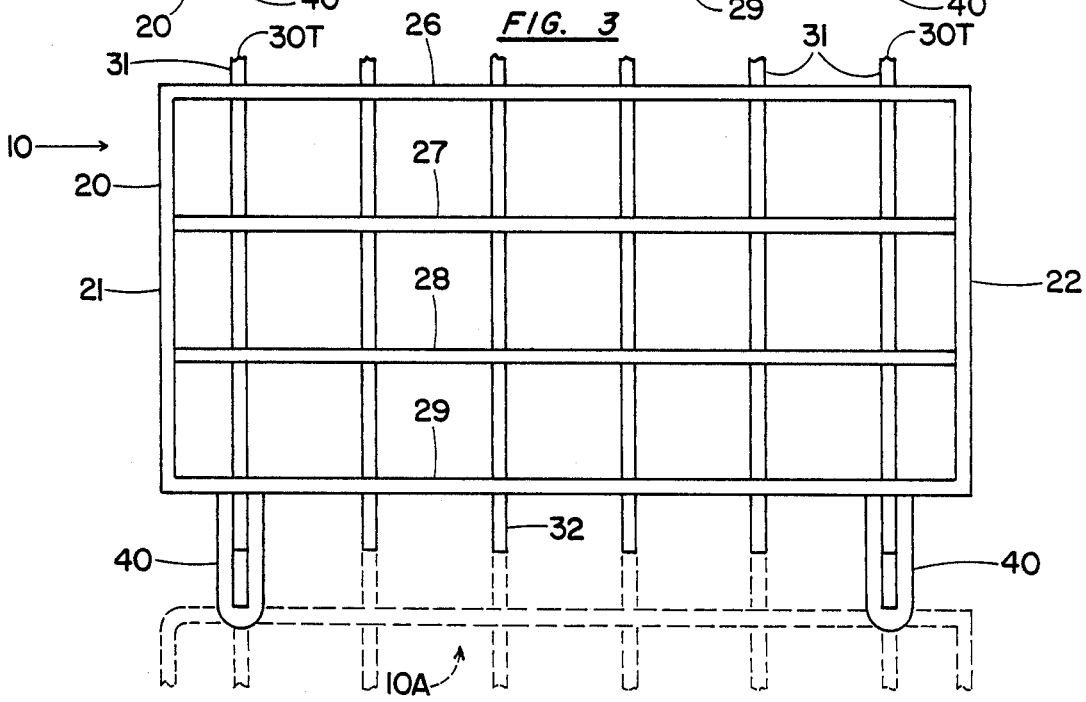
FIG. 3 is a side elevational view thereof.

The retail display cube of the present invention (e.g. 10) generally comprises: a pair of transversely spaced, upright grids (e.g. 20); a plurality of substantially rectangular and directionally longitudinally aligned parallel spacer members (e.g. 30) for spacing the grids, each spacer member extending uprightly above (31) and uprightly below (32) the co-elevational grids; and inter-cubes attachment means (e.g. 40) consisting solely of U-shaped clips carried by upright lower-lengths (32) of the two terminal spacer members (e.g. 30T).

The upright grids (20) depicted are substantially identical and herein each comprises six metallic wires connected in a common plane and including columnar wires 21 and 22 and further including directionally longitudinally extending horizontal row wires 26–29. Each grid has a directionally longitudinal top-end (e.g. row wire 26) overlying a substantially parallel bottom-end (e.g. row wire 29).

Each of the upright and substantially rectangular, parallel spacer members 30 comprises two upright-sides (30M, 30N) and a directionally transverse horizontal top-side 36 overlying a substantially parallel horizontal bottom-side 37. Each of said wire spacer members and at their said upright-sides is affixed (e.g. by welding 35) to the respective grids 20. Herein, six co-axial wire spacer members 30 are employed including two terminal members 30T and four intermediate members. Each of the spacer members upright-sides (30M, 30N) extends similar distances above and below grids 20. For example, 31 indicates an upright-side upper-length extending above grid top-end 26, and 32 indicates an upright-side lower-length extending below grid bottom-end 29.

The inter-cubes attachment means (e.g. 40), which permits vertically aligned and secure removable attachment of a retail display cube (10) to a similar cube (10A) stacked immediately below, is carried by both lower-lengths (32) of both terminal spacer members (30T). Inter-cubes attachment means embodiment 40 takes the form of four upright U-shaped clips (40), each clip including upright linear parallel wings 41 (having gap 45) and a toe-like curved lower-terminus 42. Each wing 41 has an upper-region lying along and below the proximal grid plane and therefrom extends along and is affixed (e.g. welding 43) to lower-length 32 of its host spacer member 30T. Of similar upright length to said upper-region, each wing 41 also has a lower-region extending deeply below the host spacer member 30T. The toe-like curved lower-terminus 42 projects directionally transversely outwardly from parallel wings 41 and beyond the overlying grid plane.

Though already having been alluded to, the inter-cubes attachment (40) between a cube 10 and a similar cube (10A phantom lines) stacked immediately therebelow operates as follows. As a first step, the operator stations a basal cube (10A) upon a countertop or other underlying substrate, whereby the transverse spacer members occupy vertical planes. In the next step, the operator maneuvers cube 10 above the basal cube (10A) and visually aligns the vertical spacer members of both cubes, whereby spacer lower-lengths (32) of overlying cube 10 are vertically aligned with spacer upper-lengths (31A) of basal cube 10A. Finally, the operator permits the overlying cube to rest upon the basal cube, whereupon clip wings 41 abuttably flank spacer upper-lengths (31A) of the basal cube. Accordingly, the so positioned four clips (40) of the top cube ensure that it will be in a vertically "plumb" and securely removably attached relationship to a basal cube (10A) stacked immediately therebelow.

From the foregoing, the construction and operation of the retail display wire cube will be readily understood and further explanation is believed to be unnecessary. However, since modifications and changes will readily occur to those skilled in the art, it is not desired to limit the invention to the exact construction shown and described, and accordingly, all suitable modifications and equivalents may be resorted to, falling within the scope of the appended claims.

I claim:

1. A retail display wire cube adapted for secure removable attachment to a similar cube stacked immediately therebelow, said retail display cube comprising:

(A) a pair of upright grids located in directionally transversely spaced and substantially parallel relationship, each of said grids horizontally and directionally longitudinally therealong having a top-end overlying a substantially parallel bottom-end;

(B) a plurality of substantially rectangular spacing members which are formed of metallic wire and are respectively affixed to said spaced grids, each of said spacing members being directionally longitudinally co-axially aligned with each other at incremental spacings, said spacing members including two terminal members and a plurality of intermediate members, and both of said terminal members including two spaced-apart vertical upper-lengths located above the grids' top-ends and also including two spaced-apart vertical lower-lengths extending below the grids' bottom-ends; and (C) U-shaped attachment means permitting secure removable attachment of said retail display wire cube to a similar cube stacked immediately therebelow, said attachment means being carried by all lower-lengths of said terminal spacing members, and each said attachment means lying along and below the upright plane of the cube grid portion and having a lower-terminus located deeply below its host transverse spacing member, the vertical legs of the U-shaped attachment means abuttably flanking the vertical upper-lengths of both terminal members of said similar cube stacked immediately therebelow.

2. The retail display wire cube of claim 1 wherein each said attachment means comprises a U-shaped clip, said clip including a pair of spaced-apart vertical wings and a toe-like curved lower-terminus, said wings lying along and below the upright grid plane and including wings lower-regions located deeply below the host transverse spacing member and there being adapted to abuttably flank spacing member upper-lengths of a cube stacked immediately therebelow, and said clip toe-like lower-terminus projecting directionally transversely outwardly from said grid plane.

3. A retail display wire cube adapted for secure removable attachment to a similar cube stacked immediately therebelow, said retail display cube comprising:

(A) a pair of upright grids located in directionally transversely spaced and substantially parallel relationship, each of said grids comprising a plurality of linear columnar wires and a plurality of directionally longitudinally extending lineal row wires including a top-end wire overlying a parallel bottom-end wire;

(B) a plurality of substantially rectangular spacing members formed of metallic wire and respectively affixed to said spaced grids, each of said spacing members being directionally longitudinally co-axially aligned with each other at incremental spacings, said spacing members including two terminal members and a plurality of intermediate members, and both of said terminal members including two spaced-apart vertical upper-lengths located above the grids' top-end row wires and also including two spaced-apart vertical lower-lengths extending below the grids' bottom-end row wires; and (C) inter-cubes attachment means permitting secure removable attachment of said retail display wire cube to a similar cube stacked immediately therebelow, said inter-cubes attachment means consisting solely of clips relegated to all lower-lengths of said terminal spacing members, each said slip comprising a pair of spaced-apart vertical wings and a toe-like lower-terminus, said wings including a vertical upper-region lying alongside and affixed to a spacing member lower-length and also a colinear lower-region located deeply below the same spacing member lower-length whereby said wings lower-regions are adapted to abuttably flank a spacing member upper-length of a similar cube stacked immediately therebelow, and said clip toe-like lower-terminus projecting directionally transversely outwardly from the clip vertical wings portion.

4. The retail display wire cube of claim 3 wherein the wings upper-regions flank the host spacing member lower-lengths and the toe-like lower-terminus is curbed, and said clip being singularly constructed of a metallic material.

5. A retail display wire cube securely removably attached to a similar cube stacked immediately below, and comprising:

(A) a pair of upright grids located in directionally transversely spaced and substantially parallel relationship, each of said grids comprising a plurality of linear columnar wires and a plurality of directionally longitudinally extending linear row wires including a top-end wire overlying a parallel bottom-end wire;

(B) a plurality of substantially rectangular spacing members formed of metallic wire and respectively affixed to said spaced grids, each of said spacing members being directionally longitudinally co-axially aligned with each other at incremental spacings, said spacing members including two terminal members and a plurality of intermediate members, and both of said terminal members including:

(Bi) two spaced-apart vertical upper-lengths extending above the grids' top-ends, (Bii) two spaced-apart vertical lower-lengths extending below the grids' bottom-ends, (Biii) a horizontal top-side located above the grids' top-ends, and (Biv) a horizontal bottom-side located below the grids' bottom-ends; and (C) inter-cubes attachment means securely removably attaching a said retail display wire cube to a similar cube stacked immediately therebelow, said inter-cubes attachment means consisting solely of clips relegated to all lower-lengths of said terminal spacing members, each said clip comprising a pair of spaced-apart vertical wings and a toe-like curved lower-terminus, said wings including a vertical upper-region lying alongside and affixed to a spacing member lower-length and also a colinear lower-region located deeply below the same spacing member lower-length whereby said wings lower-regions abuttably flank a spacing member upper-length of a similar cube stacked immediately therebelow, and said clip toe-like lower-terminus projecting directionally transversely outwardly from the clip vertical wings portion.

* * * * *

UNITED STATES PATENT AND TRADEMARK OFFICE

CERTIFICATE OF CORRECTION

PATENT NO. : 4,940,148

DATED : July 10, 1990

INVENTOR(S) : Joel H. Alperson

Figure 4:
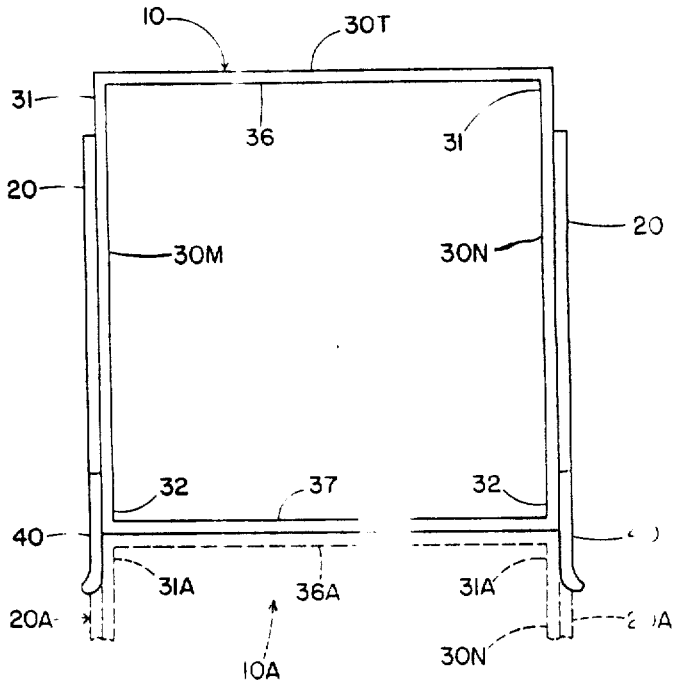
FIG. 4 is an endward elevational view thereof, as seen along line 4—4 of FIG. 1.
Figure 5:
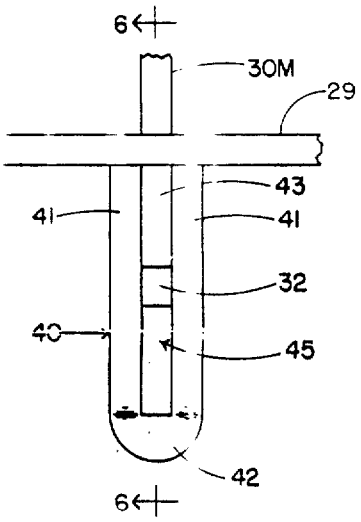
FIG. 5 is a detail view of FIG. 3 and focused at the inter-cubes attachment means.
Figure 6:
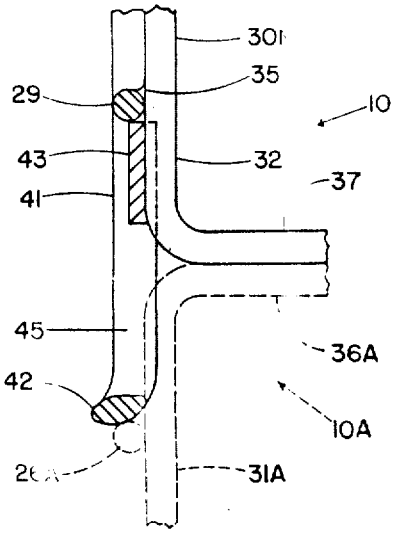
FIG. 6 is a sectional elevational view taken along line 6—6 of FIG. 5.

It is certified that error appears in the above-identified patent and that said Letters Patent is hereby corrected as shown below:

The sheet of drawing consisting of Figs. 4-6 should be added as shown on the attached sheet.

Signed and Sealed this

Fifth Day of November, 1991

*Attest:*

HARRY F. MANBECK, JR.

*Attesting Officer*

*Commissioner of Patents and Trademarks*